United States Patent [19]

Phillips et al.

[11] 3,987,237

[45] Oct. 19, 1976

[54] ELECTRIC FURNACE WALL CONSTRUCTION

[75] Inventors: Robert J. Phillips, Schenectady; Douglas W. Shattuck, Scotia, both of N.Y.

[73] Assignee: General Electric Company, Schenectady, N.Y.

[22] Filed: Oct. 29, 1975

[21] Appl. No.: 626,787

[52] U.S. Cl. ..... 13/25; 219/550; 110/1 A

[51] Int. Cl.[2] ..... H05B 3/06

[58] Field of Search ..... 13/20, 25, 35; 219/390, 219/406, 536, 537, 550; 110/1 A

[56] References Cited

UNITED STATES PATENTS

| | | | |
|---|---|---|---|
| 1,768,865 | 7/1930 | Smalley | 13/25 |
| 2,591,723 | 4/1952 | Sampson | 110/1 A X |
| 3,368,802 | 2/1968 | Morgan et al. | 110/1 A X |

*Primary Examiner*—R. N. Envall, Jr.
*Attorney, Agent, or Firm*—John F. Ahern; James W. Mitchell

[57] ABSTRACT

An electric furnace wall construction is provided and comprises a plurality of layers of heat insulating fiberboard overlying each other. Certain of the layers of fiberboard are apertured to receive ceramic hangers which support a serpentine arrangement of electric strip resistance heaters. The construction is held together by a plurality of studs and mating locking washers.

10 Claims, 4 Drawing Figures

Fig. 1
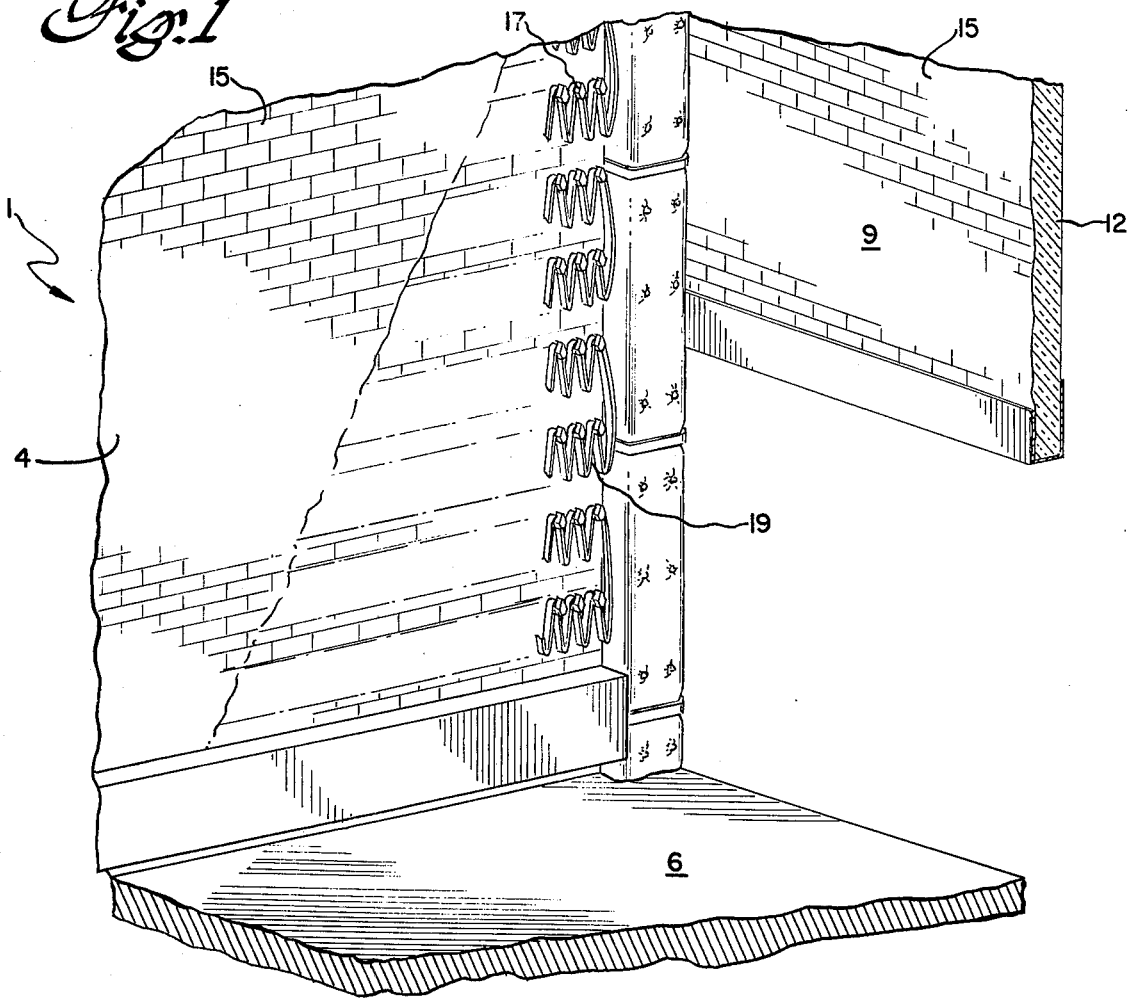
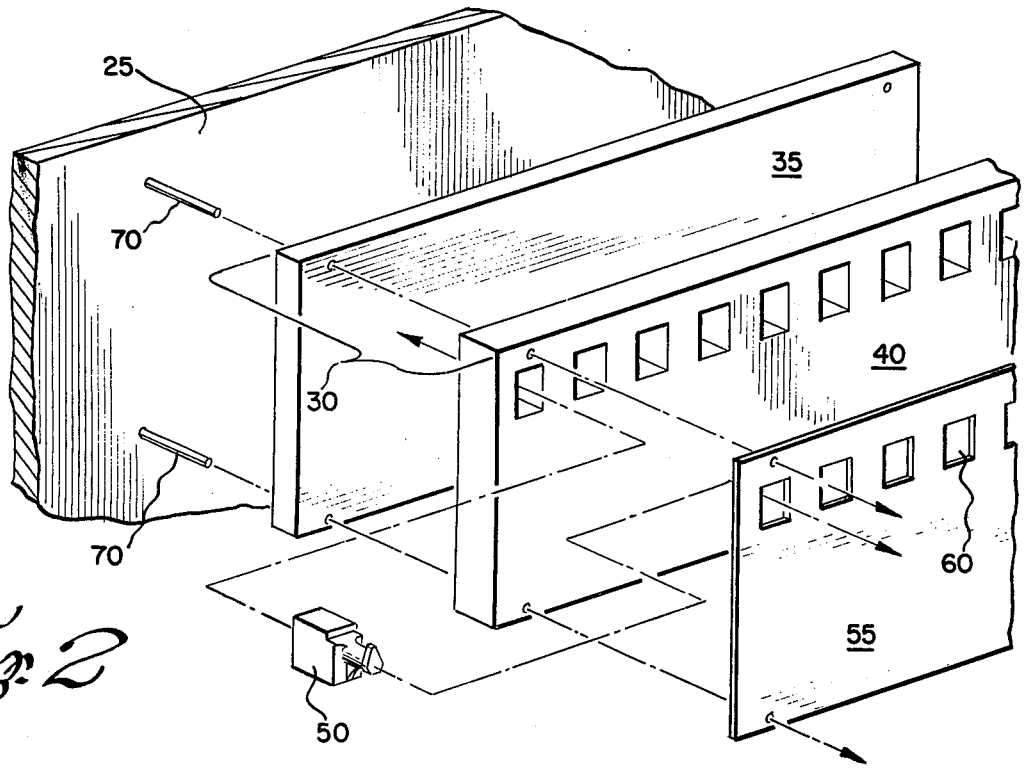
Fig. 2

ELECTRIC FURNACE WALL CONSTRUCTION

BACKGROUND OF THE INVENTION

1. Field of the Invention

The invention relates to a wall structure for an electric furnace.

2. Description of the Prior Art

Electric ovens, particularly those used for annealing, comprise large cavities or compartments having hangers disposed on the inside thereof and usually have a serpentine arrangement of electric resistance heater strips supported by the hangers. The walls of such furnaces are typically formed from an outer structural layer, oftentimes formed from sheet steel, and a heat insulating inner layer to which the hangers are secured. It has been the practice to form this inner layer from firebrick or other dense refractory materials. These dense refractory materials conduct substantial amounts of heat from the interior of the furnace to the outer shell thereby allowing the shell to heat to excessive temperatures. Allowing such heat to reach the outer shell lowers the overall efficiency of the furnace to unacceptable levels. The electric furnace wall construction of the present invention prevents excessive amounts of heat from being transferred from the interior of the furnace to the outer shell.

In normal use, the dense refractory materials or firebrick employed in prior art electric furnaces and the hangers used therein deteriorate requiring a periodic rebuilding of the walls. Due to the weight of the refractory materials employed in prior art electric furnace walls and the number of bricks required, this rebuilding is time-consuming and very costly, particularly with respect to the ceiling which usually must be domed. The rebuilding and any other routine maintenance of the electric furnace wall construction of the present invention may be performed economically in a minimal amount of time.

The firebrick and other refractory materials of prior art electric furnaces retain substantial quantities of heat. Thus, prior art electric furnaces require excessive amounts of time to reach operating temperature and to cool down therefrom which also lowers the overall efficiency of the furnace and therefore increases the costs of any manufacturing process in which heating in such a furnace is a required step. The electric furnace wall construction of the present invention does not retain such substantial amounts of heat and therefore lessens the amount of time required to heat to operating temperatures the interior of a furnace in which it is employed. Likewise, the time period required for cooling an electric furnace employing the wall construction of the present invention is also lessened. Therefore, an electric furnace employing the wall construction of the present invention is more efficient to operate than prior art electric furnaces and therefore makes manufacturing processes in which such a furnace is employed less costly.

Finally, the high densities of the firebrick and refractory materials employed in prior art furnaces make the furnace doors extremely heavy and therefore cumbersome to operate. However, the electric furnace wall construction of the present invention is light in weight compared to such prior art furnace walls making the doors employing the construction of the present invention relatively light in weight and easy to operate.

Therefore, it is an object of the present invention to provide an electric furnace wall construction having heat insulative properties which present an outer shell of an electric furnace which employs such a construction from reaching excessive temperatures when the furnace is operating.

It is another object of the present invention to provide an improved electric furnace wall construction which is capable of being rebuilt and routinely maintained at relatively low costs and in minimal amounts of time.

It is another object of the present invention to provide an improved electric furnace wall construction which retains relatively small quantities of heat.

It is another object of the present invention to provide an improved electric furnace wall construction which is relatively light in weight making a door in which the construction is employed easy to operate.

SUMMARY OF THE INVENTION

The objects of the present invention, in one embodiment thereof, are attained by providing an electric furnace wall comprising a plurality of layers of insulating mineral fiberboard or the like for structural and heat insulative purposes. A first or outer layer of insulating mineral fiberboard lines the interior of an outer electric furnace shell. An intermediate or second layer of insulating mineral fiberboard overlies the outer layer and is provided with apertures which accept the outer ends of hangers employed to support a serpentine arrangement of electric resistance strip heaters. The midportions of the hangers are of lesser cross section than the outer portions of the hangers and are received within mating apertures in an inner or third layer of insulating fiberboard which overlies the intermediate layer. The hangerreceiving apertures in the innermost layer being smaller than the apertures in the intermediate layer limit horizontal or inward movement of the hangers. The fiberboard layers have the required strength to support the hangers and the electric strip resistance heaters. The assembly of the layers of insulating fiberboard is attached to the outer shell by studs and mating locking washers.

BRIEF DESCRIPTION OF THE DRAWINGS

FIG. 1 is a perspective view of an electric furnace employing one form of prior art wall construction.

FIG. 2 is an exploded view of one embodiment of the electric furnace wall construction of the present invention.

DESCRIPTION OF A PREFERRED EMBODIMENT

Figure 3:
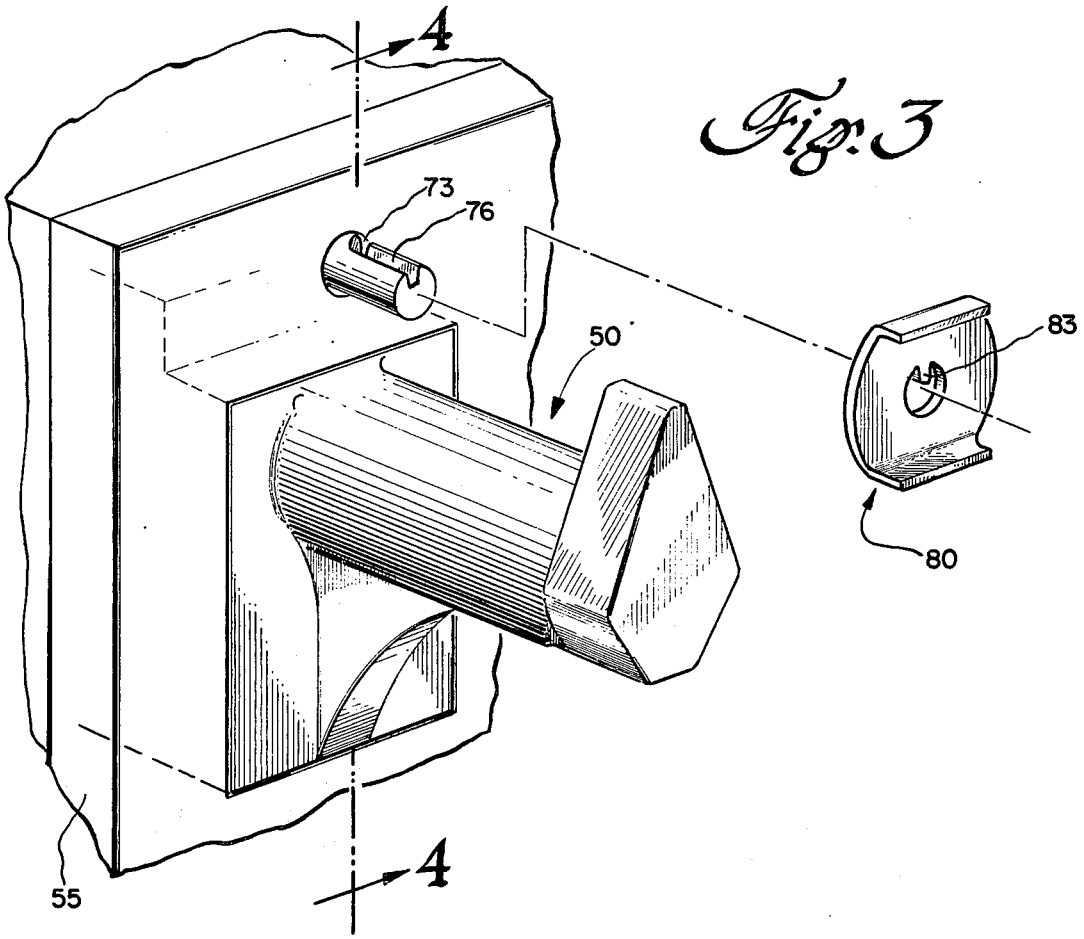
FIG. 3 is a perspective view of the electric furnace wall construction of the present invention partially disassembled to show the details of a fastening means employed therewith.

FIG. 1 shows an electric furnace 1 employing one form of prior art wall construction. Furnace 1 comprises a plurality of side walls, one of which is shown at 4, a ceiling (not shown), a floor 6 and a door 9 providing access to the furnace interior. Typically, the walls and door of a prior art electric furnace such as the one shown herein are constructed from a layer of sheet steel 12 lined with dense refractory material such as firebrick 15. Supported within the furnace walls, are hangers 17 which themselves support serpentine arrangements of electric resistance heater strips 19 which are provided to heat the furnace to its operating temperature.

It has been found that such prior art electric furnace wall constructions are deficient in a number of ways. First, the ceramic strap hangers often break and must be replaced. With the firebrick wall construction of the prior art replacement of a hanger is difficult. Secondly the firebrick 15 deteriorates and periodically the furnace walls must be rebuilt. The rebuilding of a wall construction from such a large number of dense and thus heavy refractory components is very time-consuming and thus costly. The density of the firebrick makes door 9 extremely heavy and therefore quite difficult to operate. The heat transfer properties of such a prior art electric furnace wall construction are also deficient. The firebrick employed in such prior wall constructions conducts substantial quantities of heat to outer shell 12 causing outer shell 12 to reach excessive levels of temperature during operation of the furnace. This has the effect of making the furnace unacceptably inefficient. The firebrick also stores large quantities of heat. Because of this property of high heat storage, prior art electric furnaces such as that shown in FIG. 1 require long periods of time to heat the interior thereof to operating temperatures. Likewise, such prior art electric furnaces require long periods of time to cool down after operation. These disadvantages associated with such prior art electric furnaces as that shown in FIG. 1 are overcome by the electric furnace wall construction of the present invention.

We are aware that U.S. Pat. No. 3,705,253 issued Dec. 5, 1972 to Hicks teaches the use of soft fibrous insulation in an industrial furnace to replace refractory brick. While this is an advance in the art, the aforementioned patent utilizes an inner hard refractory ceramic plate containing many integral hanger-type hook means which support the electric heating elements. Such a structure is bound to be susceptible to fracture due to thermal shock, particularly the hanger elements, as are the hangers of our invention. Additionally, the entire ceramic sheet may crack or fracture due to thermal shock. In either case an entire panel and many hangers must be replaced. In accord with our invention each hanger is held only by inner fiberboard insulator 55, which is removable. A broken or otherwise failed hanger may be repaired with high temperature refractory cement. Should this not be feasible for some reason,, or if a plurality of hangers must be replaced, this is done merely by removing the locking washers for the fiberboard panel holding the hangers, removing the panel, replacing the hanger or hangers, replacing the fiberboard panel 55 and replacing the twist-lock washers 80.

Figure 4:
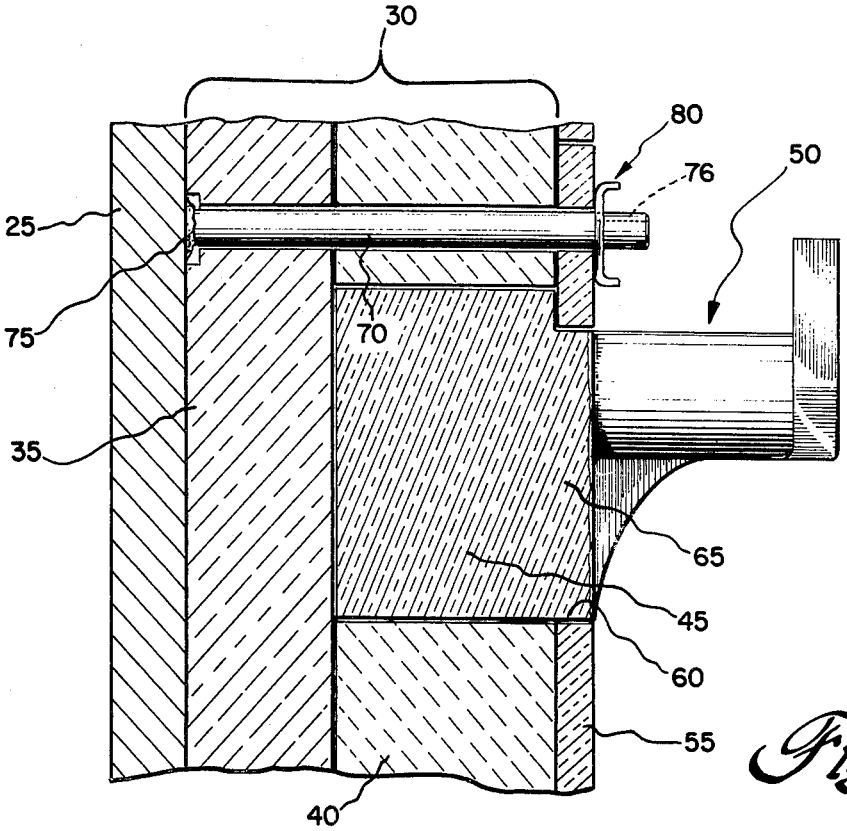
FIG. 4 is a sectional view taken along line 4—4 of FIG. 3 in a completely assembled configuration.

FIGS. 2, 3 and 4 shows an electric furnace wall construction employing a plurality of layers of mineral fiberboard overlying an outer shell. The electric furnace wall construction of the present invention comprises an outer shell 25 formed from sheet steel or other material of similar structural rigidity covered on an inner surface thereof by a set 30 of insulating mineral fiberboards of heat insulating material such as, for example, Babcock and Wilcox KAOWOOL comprised of fibers of alumina-silica fireclay. In a preferred embodiment, mineral insulating fiberboard set 30 comprises an outer solid panel 35 of heat insulating mineral fiberboard 35 and an intermediate apertured panel of heat insulating mineral fiberboard 40 overlying the inner face thereof. Each of the apertures of board 40 is sized to mate with a large dimension outer end 45 of a ceramic high-temperature-resistant hanger 50 provided to support, with a multiplicity of similar hangers, a serpentine, or other, arrangement of electric resistance heater strips 19 for the heating of a furnace employing the wall construction of the present invention.

In a preferred embodiment of our invention we prefer to utilize as the fiberboard insulation thereof the aforementioned commercially available KAOWOOL which is an agglomerate of kaolin fibers having lengths up to 10 inches which are interlaced to form a strong resilient blanket or sheet having excellent insulating properties without the use of added binders. Sheets and blocks of this insulating material have a density range of from 14 to 18 pounds per ft.$^3$, a working temperature for continuous use of 2300° F, a melting point of greater than 3100° F, a modulus of rupture of 55 PSI, a compressive strength indicated by 5 percent distortion at 3500 lbs./ft.$^2$ and a linear shrinkage of from 0 at 1800° F to 2 percent at 2400° F. The thermal conductivity of this material varies from 0.39 to 1.01 BTU/ft.$^2$/in./hr./° F at temperatures ranging from 400° F to 1600° F. Its composition is approximately as follows: $SiO_2$—52%; $Al_2O_3$—42%; $TiO_2$—2%; $Fe_2O_3$—1%; MgO—0.3%; $Na_2O$—0.006%, all by weight.

While this material is preferred at the fibrous heat insulating sheets used in the invention, other lightweight, effective, high-temperature thermal insulations such as other ceramic fibers, asbestos and the like, may be used.

Referring particularly to FIG. 2, it can be seen that a single set 30 of composite insulating fiberboard 30 is capable of accommodating a multiplicity of hangers 50. Therefore, the electric furnace wall construction of the present invention may be formed from far fewer individual structural components than a prior art electric furnace wall construction formed from individual firebricks. Moreover, since the insulating fiberboards of the present invention are much less dense than the firebrick and other refractory materials employed in prior art electric furnace wall constructions, a wall constructed in accordance with the present invention is much lighter in weight than prior art furnace walls. The light weight of the fiberboards, coupled with the requirements of relatively few individual fiberboard sets needed for lining an electric furnace wall, makes rebuilding and routine maintenance of such a wall such as the replacement of individual hangers much less time-consuming and costly than similar maintenance performed on a prior art electric furnace wall.

Overlying intermediate apertured mineral fiberboard 40 is an inner insulating mineral fiberboard 55 having a plurality of apertures 60 therein which mate with midportions 65 of hangers 50. These midportions are of lesser cross section than the outer ends 45 of hangers 50. Therefore, as best shown in FIG. 4, inner fiberboard 55 limits the movement of hanger 50 in a horizontal direction preventing that hanger from pulling out of the wall construction of the present invention. Hanger 50 will normally be formed from a relatively dense material, and may therefore be capable of conducting some heat along its length. Since outer insulating fiberboard 35 is solid it will effectively insulate shell 25 from most of such heat conducted along hanger 50 preventing shell 25 from heating to excessive temperatures.

The electric furnace wall construction of the present invention is provided with a plurality of means attached thereto for supporting with minimal heat less the plurality of insulating fiberboards of the invention and may comprise, for example, studs 70 fixed to the inner surface of outer shell 25 at 75 as by welding or similar methods. Each of studs 70 has means cooperating with locking washers for locking the respective insulating boards in place and may, for example, include an arcuate groove 73 and a longitudinal groove 76 disposed between arcuate groove 73 and the inner end of the stud. Each of the locking washers 80 includes means for cooperating with the mounting studs to become locked thereupon and may for example be a locking tab 83. Each washer 80 is locked to a mating stud 70 by sliding the washer over the stud with the tab in engagement with groove 76 until the tab meets arcuate groove 73. The locking washer is then turned so that tab 83 moves within arcuate groove 73, locking the washer to the stud. Studs 70 cooperate with mating locking washers 80 which, with outer shell 25, press the insulating fiberboards employed in the present invention into an assembled relationship. While a preferred set of cooperating means on the studs and the locking washers for locking the same together has been shown, it is obvious that other locking means may be used. Locking washers 80 in combination with studs 70 provide a time-saving means for assembling and disassembling the electric furnace wall construction of the present invention for the routine maintenance thereof. To replace any deteriorated components of the electric furnace wall of the present invention as, for example, a broken hanger, it is only necessary to turn locking washers 80 to disengage them from studs 70 and remove inner fiberboard 55. Any hangers 50 needing replacement are readily accessible with this removal of inner fiberboard 55. Likewise, should it be found that any of the fiberboard panels has deteriorated to the point of requiring replacement, this can be done quickly by simply sliding the panels over studs 70 removing them from the assembly and sliding any replacement panels back over the studs in the opposite direction, thereby relining outer shell 25. Finally, after any components of the electric furnace wall construction of the present invention requiring replacement have been replaced, fiberboard 55 or its replacement may then be slid back on studs 70 and locking washers 80 replaced on studs 70 to hold the components of the now rebuilt electric furnace wall in an assembled relationship.

In order to prevent heat leakage the respective outer, intermediate and inner fiberboards are lapped and staggered so that seams or joints in adjacent layers do not coincide, providing a heat leakage path.

It can be seen that the electric furnace wall construction of the present invention being relatively light in weight and comprising relatively few components is capable of being rebuilt or maintained in relatively short periods of time. The light weight of the electric furnace wall construction of the present invention also ensures that any furnace door to which it is applied will be light in weight and therefore easy to operate. Since the insulating fiberboards employed in the present invention do not conduct substantial quantities of heat, the outer shells of furnaces employing this construction will remain relatively cool, making such furnaces acceptably efficient. The efficiency of electric furnaces employing the present invention will also be enhanced since the insulating fiberboards will not store substantial quantities of heat, thus reducing the times required to heat and cool the furnace.

While differing thicknesses of the respective insulating fiberboards 35, 40 and 55 of the furnace wall insulating system of the present invention may be required, depending upon the heat within the oven or furnace and upon the exact material from which the fiberboards are fabricated we find that utilizing the aforementioned kaolin based insulating boards commercially available from Babcock and Wilcox under the commercially available material referred to as KAOWOOL, and insulating against a temperature of 2300° F, it has been found sufficient to use an outer fiberboard 35 approximately 2 inches thick, an intermediate apertured fiberboard 40 approximately 3 inches thick, and finally an inner, hanger-retaining apertured fiberboard approximately ½ inch thick. All of the foregoing fiberboards are impaled on suitable heat-resistant studs 70, as for example INCONEL 601, which are welded to a steel outer furnace shell and are held in place by cooperating locking means, as for example twist-on locking washers, as described hereinbefore.

The insulation system of the present invention is not limited to the exact arrangement as illustrated. Thus, for example, the main insulation provided by the 3 inch thick central apertured fiberboard may be alternatively provided by a well-known soft blanket of loosely packed KAOWOOL or equivalent light mineral or ceramic fiber insulation and an added ½ inch, for example, apertured fiberboard may be provided immediately inboard of fiberboard 35 to anchor the outer portion of hangers 50. Similarly, other known fiberboards and high-temperature insulation materials may be used rather than the KAOWOOL described in the specific embodiment herein.

In addition to the above modification wherein a soft blanket of insulation, as for example KAOWOOL is inserted partly in liew of member 40, a layer of the same material may be inserted in addition thereto. One specific addition of particular value is a layer of loosely packed KAOWOOL of moderate thickness such as for example approximately 0.5 inch, added between members 35 and 40. Such a layer is of great value in minimizing heat loss through hangers 50. Such a member is installed from a continuous roll and helps to seal seams against heat loss.

While there has been shown and described a preferred embodiment of the electric furnace wall construction of the present invention, it will be apparent to those skilled in the art that modifications may be made without departing from the substance of this invention and is intended by the appended claims to cover such modifications as come within the spirit and scope of this invention.

What is claimed is:

1. An improved electric heater wall assembly for industrial heaters wherein electric resistance heater elements are supported from hangers affixed to said wall assembly and comprising:

a. a metallic outer wall;

b. a plurality of heat-resistant metallic studs affixed to said outer wall for supporting insulation means thereon;

c. a composite lightweight fibrous insulation means supported upon said metallic studs;

d. a plurality of electric conductor heater element support hangers extending into and supported by said insulating means independently of one another;

e. said hangers being insulated from said outer metallic wall by said insulation means and adapted to be replaced without requiring replacement of any other of said hangers; and f. locking means disposed on the inner ends of said studs holding said insulating means fixedly in place.

2. The improved heater wall assembly of claim 1 wherein said insulation means includes an outer imperforate insulation member which insulates the outboard ends of said hangers from said outer wall; an intermediate insulating member having apertures therein adapted to support a plurality of individually replaceable hangers and prevent lateral movement thereof; and an inner apertured insulating member having apertures smaller than the apertures in said intermediate insulating member and adapted to support said hangers in fixed position and prevent inward motion thereof.

3. An improved electric furnace wall for industrial furnaces wherein said wall supports an electrical heating member and comprising:

a. a metallic outer furnace wall, b. a plurality of hangers fixed to the side walls for supporting said heating member, each of said hangers including an outer end and a midportion of lesser cross section than said outer end;

c. an outer imperforate member of fibrous insulating material interposed between said outer wall and the outer ends of said hangers;

d. an intermediate fibrous heat insulating member having a plurality of apertures disposed therein and mating with the outer ends of said hangers;

e. an inner heat insulating member disposed adjacent to the inner face of said intermediate insulating member having a plurality of apertures disposed therein and mating with the midportions of said hangers, said apertures being smaller in size than the apertures disposed in said intermediate insulating member; and f. means to removably support said insulating members on said outer shell, g. said hangers being supported by said insulating member and said inner insulating member limiting horizontal movement of said hangers;

h. whereby said intermediate inner insulating members and said hangers are readily replaceable for the repair and maintenance of the furnace wall.

4. The furnace wall of claim 3, wherein said means to support said insulating members comprises:

a. a plurality of studs having inner and outer ends, said outer ends being fixed to said outer shell; and b. a plurality of locking washers mating with said studs.

5. The furnace wall of claim 3, wherein each of said studs is of cylindrical shape and includes an arcuate groove spaced from said inner end of said stud and a longitudinal groove extending from said inner end to said arcuate groove and each of said washers includes a central aperture and a locking tab extending into said central aperture, said locking tab being receivable within said longitudinal groove and movable into said arcuate groove for locking said washers to said studs thereby holding said first and second fiberboards in place.

6. The furnace wall of claim 3, wherein said ceramic insulating members comprise:

rigid panels of compressed ceramic fibers having good mechanical properties to support said hangers, and poor thermal conductivity in the range up to approximately 2300° F.

7. An improved electric furnace wall structure comprising:

a. a metallic outer shell, b. a plurality of metallic studs affixed to said shell for supporting insulating members thereon, c. an outer wall insulator including a plurality of sheets of imperforate insulating material impaled upon said studs and covering said outer shell;

d. an intermediate wall insulator and hanger support including a plurality of sheets of insulating material overlaying said sheets of imperforate insulating material and containing an array of apertures for receiving and supporting outer ends of a plurality of hangers which support an electric resistance heater element within said furnace impaled upon said studs;

e. an inner wall insulator including a plurality of sheets of insulating material overlaying said intermediate wall and having a plurality of apertures therein aligned with the apertures in said intermediate insulator and of smaller dimension sufficient to engage the body of said hangers and retain the same rigidly in place impaled upon said studs; and f. locking means removably engaging said studs for rigidly fastening said insulating members in place and for allowing selective removal of at least one of each of said sheets to perform maintenance upon said wall.

8. The structure of claim 7 wherein said sheets are fabricated from pressed mineral fibers which form a rigid structure having an insulating rating for effective use under continuous operation of at least 2300° F, a compressive strength evidenced by a deformation of approximately 5 percent at a stress of approximately 3500 pounds per square inch, and a thermal conductivity of approximately 1 BTU/sq. ft./in./hr./° F.

9. The structure of claim 7 wherein said sheets are formed of fibers whose principal constituents (in excess of 90 percent by weight) are oxides of silicon and aluminum.

10. The structure of claim 7 wherein the respective sheets of outer intermediate and inner insulating members are lapped with respect to one another so as to preclude the coincidence of adjacent aligned sheet joints providing a path of thermal leakage.

* * * * *